US012077875B2

(12) United States Patent
Tsuji et al.

(10) Patent No.: US 12,077,875 B2
(45) Date of Patent: Sep. 3, 2024

(54) AIR BUBBLE REMOVING METHOD OF PLATING APPARATUS AND PLATING APPARATUS

(71) Applicant: EBARA CORPORATION, Tokyo (JP)

(72) Inventors: Kazuhito Tsuji, Tokyo (JP); Shao Hua Chang, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/469,069

(22) Filed: Sep. 8, 2021

(65) Prior Publication Data

US 2022/0106701 A1 Apr. 7, 2022

(30) Foreign Application Priority Data

Oct. 1, 2020 (JP) ..... 2020-166868

(51) Int. Cl.

| | |
|---|---|
| ***C25D 21/04*** | (2006.01) |
| ***C25D 17/00*** | (2006.01) |
| ***C25D 17/08*** | (2006.01) |
| ***C25D 17/10*** | (2006.01) |

(52) U.S. Cl.

CPC ..... *C25D 21/04* (2013.01); *C25D 17/002* (2013.01); *C25D 17/08* (2013.01); *C25D 17/10* (2013.01)

(58) Field of Classification Search

None

See application file for complete search history.

(56) References Cited

U.S. PATENT DOCUMENTS

| | | | | |
|---|---|---|---|---|
| 6,527,920 | B1 * | 3/2003 | Mayer | C25F 7/00 204/266 |
| 6,821,407 | B1 | 11/2004 | Reid et al. | |
| 6,846,392 | B1 * | 1/2005 | Stockbower | C25D 7/123 204/266 |
| 2006/0032758 | A1 * | 2/2006 | Klocke | C25D 7/123 205/220 |
| 2008/0210562 | A1 * | 9/2008 | Kawakami | C25D 17/008 204/225 |

(Continued)

FOREIGN PATENT DOCUMENTS

| | | | | |
|---|---|---|---|---|
| JP | 11248923 | * | 9/1999 | C25D 17/00 |
| JP | H11-248923 | A | 9/1999 | |

(Continued)

*Primary Examiner* — Stefanie S Wittenberg
(74) *Attorney, Agent, or Firm* — BakerHostetler

(57) ABSTRACT

A technique that ensures suppressing deterioration of a plating quality of a substrate caused by air bubbles accumulated on a lower surface of a membrane is provided. An air bubble removing method of a plating apparatus is an air bubble removing method for removing air bubble in an anode chamber 13 in a plating apparatus 1000 including a plating tank 10 and a substrate holder 30. The air bubble removing method includes: supplying a plating solution Ps from at least one supply port 70 disposed in an outer peripheral portion 12 of the anode chamber to the anode chamber and causing at least one discharge port 71 disposed in the outer peripheral portion of the anode chamber so as to face the supply port to suction the supplied plating solution to form a shear flow Sf of the plating solution along a lower surface on the lower surface 61*a* of a membrane 61 in the anode chamber.

13 Claims, 11 Drawing Sheets

(56) References Cited

U.S. PATENT DOCUMENTS

| | | | | |
|---|---|---|---|---|
| 2012/0138471 | A1* | 6/2012 | Mayer | C25D 21/12 204/275.1 |
| 2013/0334052 | A1* | 12/2013 | Chua | C25D 17/10 204/252 |
| 2016/0333492 | A1* | 11/2016 | Bergman | C25D 7/00 |
| 2017/0137959 | A1* | 5/2017 | McHugh | C25D 17/001 |
| 2019/0055665 | A1* | 2/2019 | Banik, II | C25D 17/005 |
| 2019/0085479 | A1* | 3/2019 | Banik, II | C25D 17/002 |

FOREIGN PATENT DOCUMENTS

| | | | |
|---|---|---|---|
| JP | 2000-087290 | A | 3/2000 |
| JP | 2007-534835 | A | 11/2007 |
| JP | 2008-019496 | A | 1/2008 |
| JP | 2010-168643 | A | 8/2010 |
| WO | WO 2005/060379 | A2 | 7/2005 |

* cited by examiner (B1-B1)

AIR BUBBLE REMOVING METHOD OF PLATING APPARATUS AND PLATING APPARATUS

TECHNICAL FIELD

The present invention relates to an air bubble removing method of plating apparatus and a plating apparatus. This application claims priority from Japanese Patent Application No. 2020-166868 filed on Oct. 1, 2020. The entire disclosure including the descriptions, the claims, the drawings, and the abstracts in Japanese Patent Application No. 2020-166868 is herein incorporated by reference.

BACKGROUND ART

Conventionally, as a plating apparatus that performs a plating process on a substrate, there has been known a what is called cup type plating apparatus (for example, see PTL 1). The plating apparatus includes a plating tank where an anode is disposed and a substrate holder disposed in an upper side of the anode to hold a substrate as a cathode with a plated surface of the substrate facing the anode.

In the plating apparatus, a component in an additive contained in a plating solution is decomposed or reacts by a reaction at the anode side and this possibly generates a component adversely affecting plating (this will be referred to as "the negative effect caused by the additive component"). Therefore, a technique that disposes a membrane that suppresses passing of an additive while permitting metal ions to pass through between an anode and a substrate and disposes the anode in a region (referred to as an anode chamber) comparted in a lower side of the membrane to suppress the negative effect caused by the additive component has been developed (for example, see PTL 1 and PTL 2).

CITATION LIST

Patent Literature

PTL 1: Japanese Unexamined Patent Application Publication No. 2008-19496
PTL 2: U.S. Pat. No. 6,821,407

SUMMARY OF INVENTION

Technical Problem

There may be a case where air bubbles are generated for some reason in the anode chamber in the cup type plating apparatus including the membrane as described above. In a case where the air bubbles are thus generated in the anode chamber and accumulated on the lower surface of the membrane, a plating quality of the substrate is possibly deteriorated caused by the air bubbles.

The present invention has been made in view of the above-described circumstances, and an object of the present invention is to provide a technique that ensures suppressing deterioration of a plating quality of a substrate caused by air bubbles accumulated on a lower surface of a membrane.

Solution to Problem (Aspect 1)

In order to achieve the object, an air bubble removing method of a plating apparatus according to one aspect of the present invention is for removing air bubble in an anode chamber in the plating apparatus. The plating apparatus includes a plating tank and a substrate holder. The plating tank includes a membrane disposed in the plating tank, an anode chamber comparted in a lower side of the membrane in the plating tank, and an anode disposed in the anode chamber. The substrate holder is configured to hold a substrate as a cathode with a surface to be plated of the substrate facing the anode. The air bubble removing method includes supplying a plating solution from at least one supply port disposed in an outer peripheral portion of the anode chamber to the anode chamber and causing at least one discharge port disposed in the outer peripheral portion of the anode chamber so as to face the supply port to suction the supplied plating solution to form a shear flow of the plating solution along a lower surface on the lower surface of the membrane in the anode chamber.

This aspect allows the air bubble in the anode chamber to ride the shear flow and to be effectively discharged from the discharge port. Since this allows suppressing an accumulation of the air bubble on the lower surface of the membrane, deterioration of a plating quality of the substrate caused by the air bubble can be suppressed.

(Aspect 2)

The aspect 1 may further include returning the plating solution to the anode chamber after removing the air bubble contained in the plating solution discharged from the anode chamber. According to this aspect, the plating solution that does not contain the air bubble can be supplied to the anode chamber.

(Aspect 3)

In order to achieve the object, a plating apparatus according to one aspect of the present invention includes a plating tank, a substrate holder, at least one supply port, and at least one discharge port. The plating tank includes a membrane disposed in the plating tank, an anode chamber comparted in a lower side of the membrane in the plating tank, and an anode disposed in the anode chamber. The substrate holder is disposed in an upper side of the anode chamber. The substrate holder is configured to hold a substrate as a cathode with a surface to be plated of the substrate facing the anode. The at least one supply port is disposed in an outer peripheral portion of the anode chamber. The at least one supply port is configured to supply the plating solution to the anode chamber. The at least one discharge port is disposed in the outer peripheral portion of the anode chamber so as to face the supply port. The at least one discharge port is configured to suction the plating solution in the anode chamber and discharge the plating solution from the anode chamber. The supply port and the discharge port are configured such that the discharge port suctions the plating solution supplied from the supply port to form a shear flow of the plating solution along a lower surface on the lower surface of the membrane in the anode chamber.

This aspect allows the air bubble in the anode chamber to ride the shear flow and to be effectively discharged from the discharge port. Since this allows suppressing the accumulation of the air bubble on the lower surface of the membrane, the deterioration of plating quality of the substrate caused by the air bubble can be suppressed.

(Aspect 4)

In the aspect 3, the supply port may be disposed at one side with respect to a center line of the anode chamber in the outer peripheral portion of the anode chamber in bottom view viewing the anode chamber from a lower side. The discharge port may be disposed at the other side with respect to the center line in the outer peripheral portion of the anode chamber in the bottom view. A distance from the lower surface of the membrane to the discharge port may be equal to a distance from the lower surface to the supply port. According to this aspect, the shear flow that runs along the lower surface of the membrane and heads for the other side from the one side with the center line of the anode chamber interposed therebetween can be easily formed.

(Aspect 5)

In the aspect 4, the supply port may be disposed over a whole circumference at the one side with respect to the center line in the outer peripheral portion of the anode chamber. The discharge port may be disposed over a whole circumference at the other side with respect to the center line in the outer peripheral portion of the anode chamber. According to this aspect, the shear flow that entirely runs along the lower surface of the membrane and heads for the other side from the one side with the center line of the anode chamber interposed therebetween can be easily formed on the lower surface of the membrane. This allows effectively discharging the air bubble in the anode chamber from the discharge port.

(Aspect 6)

The aspect 5 may further include a guide member disposed on the lower surface of the membrane. The guide member may be configured to guide a flow of the shear flow flowing along the lower surface of the membrane. According to this aspect, the shear flow flowing along the lower surface of the membrane can be guided by the guide member and effectively suctioned to each discharge port.

(Aspect 7)

One aspect any of the aspects 3 to 6 may further include a plating solution circulation device configured to return the plating solution discharged from the discharge port to the supply port. The plating solution circulation device may include a reservoir tank. The reservoir tank may be configured to temporarily store the plating solution discharged from the discharge port. The reservoir tank may include an air bubble removing mechanism configured to remove the air bubble contained in the plating solution supplied to the reservoir tank. According to this aspect, after the air bubble contained in the plating solution discharged from the discharge port in the anode chamber is removed by an air bubble removing mechanism, the plating solution can be returned to the supply port in the anode chamber.

(Aspect 8)

In the aspect 7, the reservoir tank may include a second supply port and a second discharge port. The second supply port communicates with the discharge port and is configured to supply the plating solution discharged from the discharge port to the reservoir tank. The second discharge port communicates with the supply port and is configured to discharge the plating solution in the reservoir tank from the reservoir tank. The second supply port is positioned in an upper side of the second discharge port. The air bubble removing mechanism has the second supply port and the second discharge port. According to this aspect, while flowing of the air bubble contained in the plating solution supplied to the reservoir tank from the second supply port in the second discharge port is suppressed, and this air bubble can float to the liquid surface using buoyancy. Accordingly, the plating solution not containing the air bubble can be flowed in the second discharge port, and therefore the plating solution not containing the air bubble can be discharged from the second discharge port and returned to the supply port in the anode chamber.

(Aspect 9)

In the aspect 7, the reservoir tank may include a second supply port, a second discharge port, and a partition member. The second supply port communicates with the discharge port and is configured to supply the plating solution discharged from the discharge port to the reservoir tank. The second discharge port communicates with the supply port and is configured to discharge the plating solution in the reservoir tank from the reservoir tank. The partition member may project upward with respect to a liquid surface of the plating solution in the reservoir tank. The partition member may extend downward with respect to the liquid surface in the reservoir tank within a range not in contact with a bottom portion of the reservoir tank. In a cross-sectional surface view of the reservoir tank, the second supply port may be disposed at one side with respect to the partition member. The second discharge port may be disposed at the other side with respect to the partition member. The air bubble removing mechanism may include the partition member. According to this aspect, flowing the air bubble contained in the plating solution supplied from the second supply port in the reservoir tank to the reservoir tank in the other side (the second discharge port side) with respect to the partition member can be suppressed. Thus, after the air bubble contained in the plating solution supplied from the second supply port to the reservoir tank is removed, the plating solution can be discharged from the second discharge port and returned to the supply port in the anode chamber.

(Aspect 10)

In one aspect any of the aspects 7 to 9, the plating solution circulation device may further include a gas purge pipe at a portion from the discharge port to the reservoir tank in a flow direction of the plating solution. The gas purge pipe may be configured to discharge a gas contained in the plating solution flowing through the portion to an atmosphere. According to this aspect, the gas contained in the air bubble in the plating solution discharged from the discharge port and flowing toward the reservoir tank can be discharged in the atmosphere via the gas purge pipe. This allows vanishing this air bubble.

DESCRIPTION OF EMBODIMENTS

Figure 1:
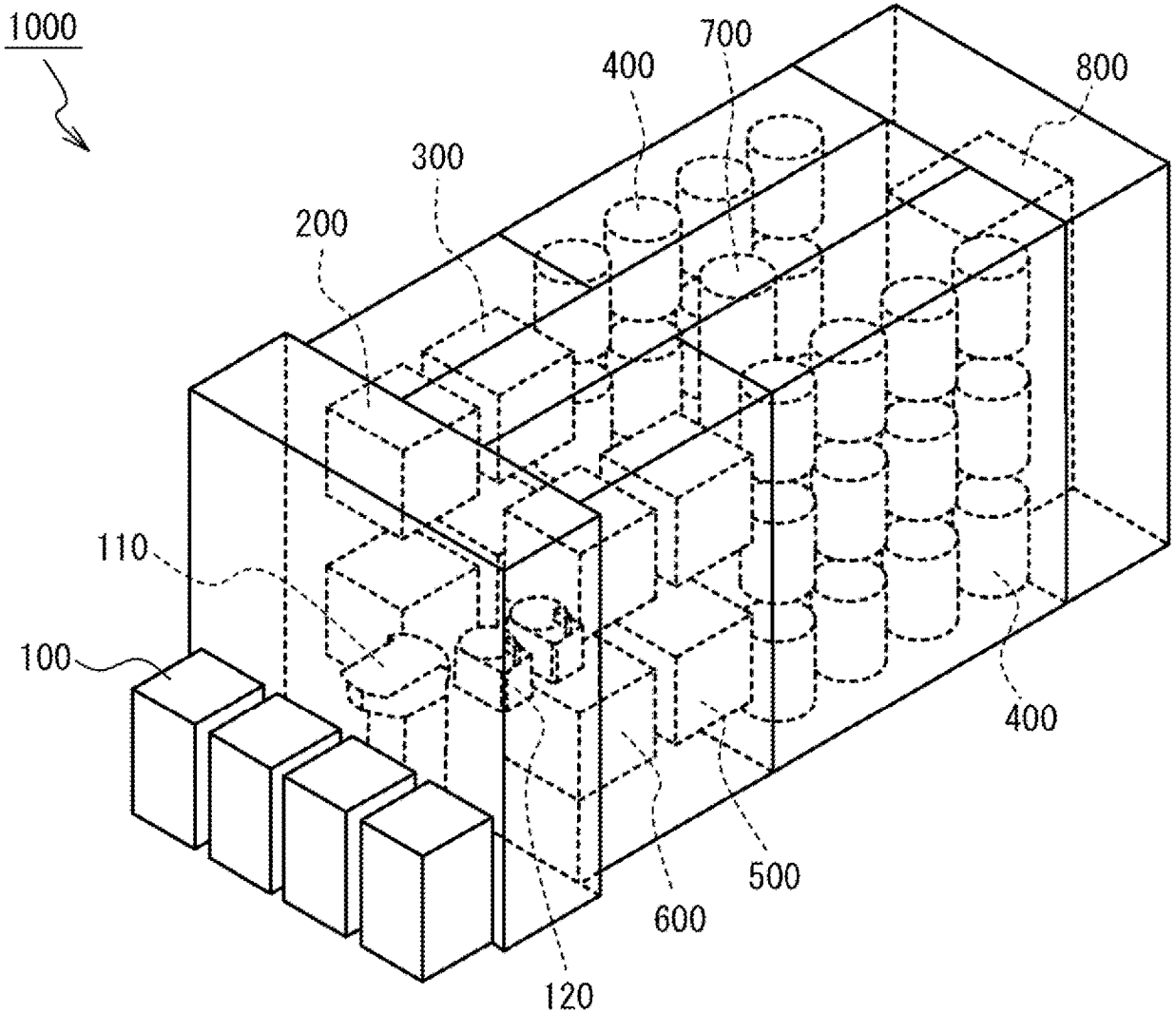
FIG. 1 is a perspective view illustrating an overall configuration of a plating apparatus according to an embodiment.

The following will describe embodiments of the present invention with reference to the drawings. In the following embodiments and modifications of the embodiments, the identical reference numerals are assigned for the identical or corresponding constitutions, and therefore such elements will not be further elaborated here appropriately. The drawings are schematically illustrated for ease of understanding features of the embodiments, and, for example, a dimensional proportion of each component is not always identical to that of an actual component. For some drawings, X-Y-Z orthogonal coordinates are illustrated for reference purposes. Of the X-Y-Z orthogonal coordinates, the Z-direction corresponds to the upper side, and the −Z-direction corresponds to the lower side (the direction where gravity acts).

Figure 2:
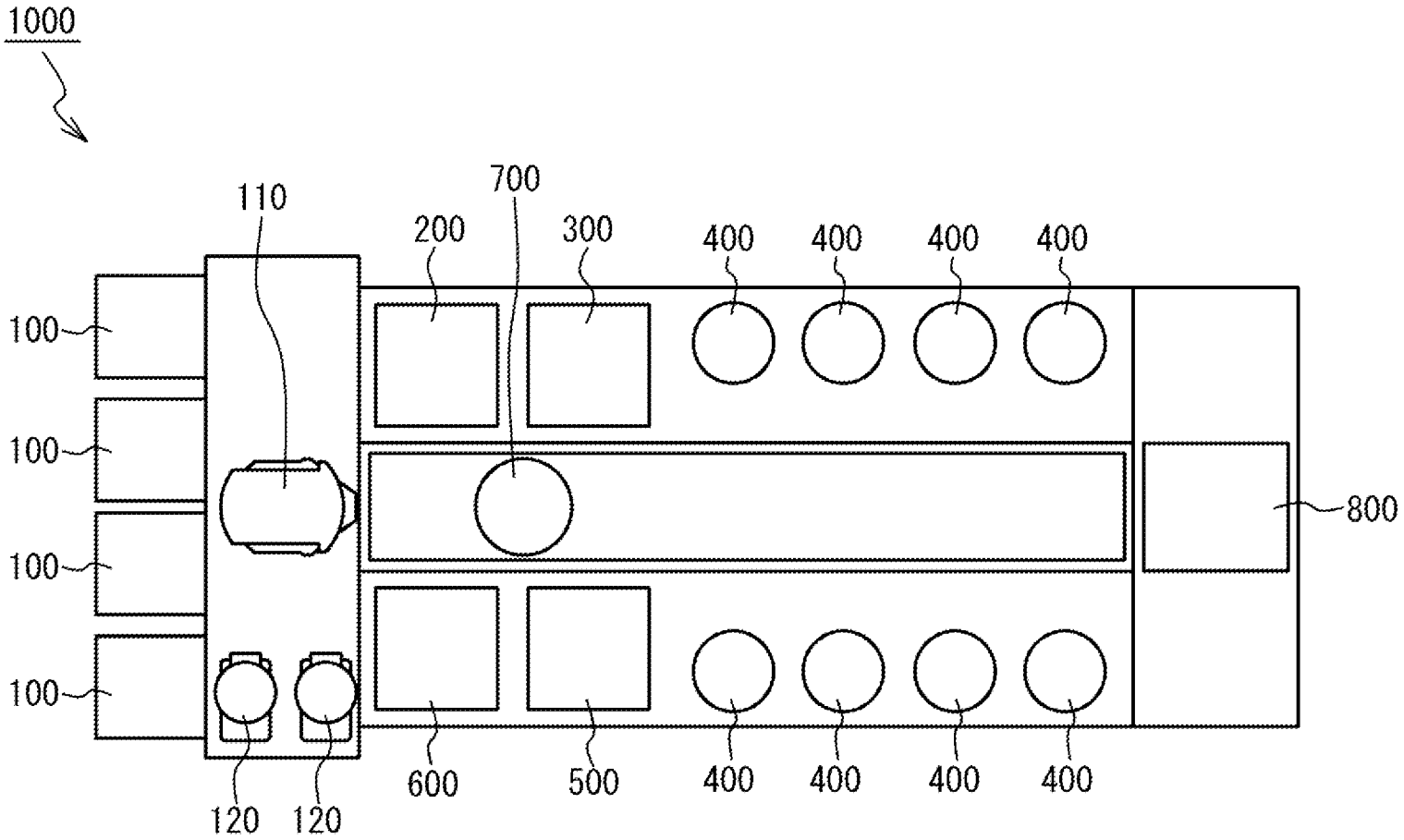
FIG. 2 is a plan view illustrating the overall configuration of the plating apparatus according to the embodiment.

FIG. 1 is a perspective view illustrating an overall configuration of a plating apparatus 1000 of this embodiment. FIG. 2 is a plan view (top view) illustrating the overall configuration of the plating apparatus 1000 of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configurations of the plating apparatus 1000 that have been described in FIG. 1 and FIG. 2 are merely examples, and are not limited to the configurations in FIG. 1 and FIG. 2.

Subsequently, the plating module 400 will be described. Since the plurality of plating modules 400 provided with the plating apparatus 1000 according to this embodiment have the similar configurations, only one plating module 400 will be described.

Figure 3:
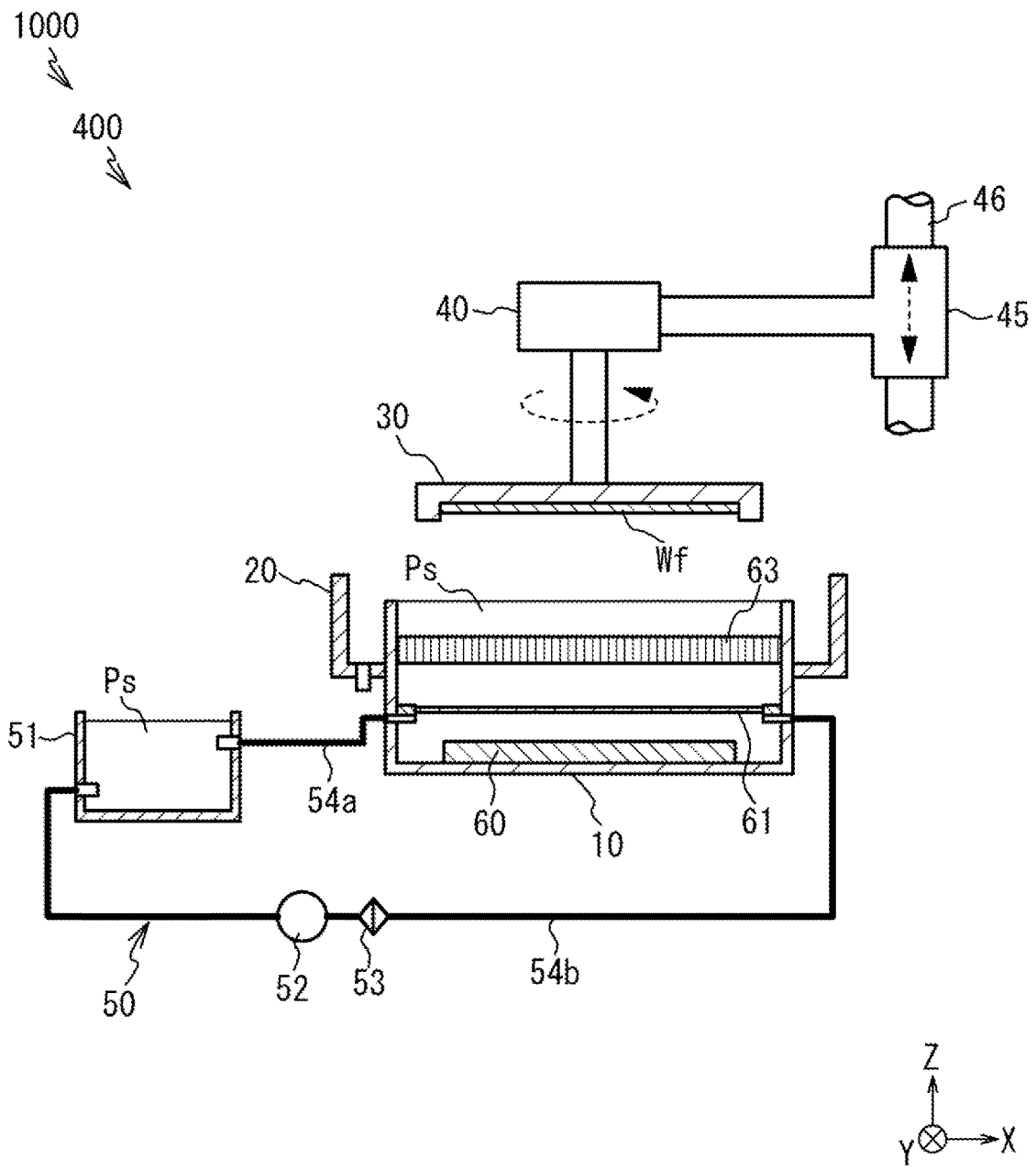
FIG. 3 is a drawing schematically illustrating a configuration of a plating module according to the embodiment.
Figure 4:
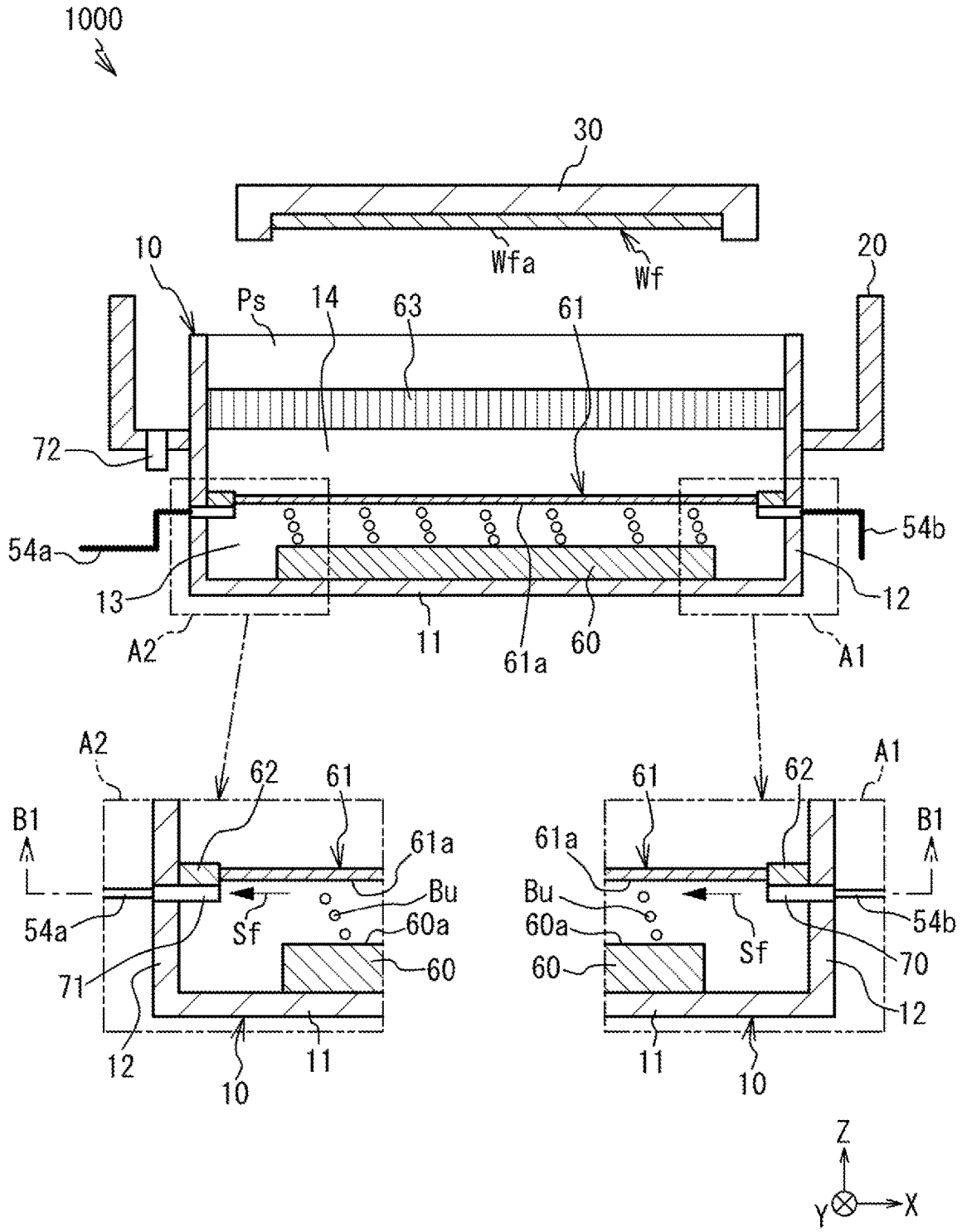
FIG. 4 is a schematic cross-sectional view illustrating an enlarged region near a plating tank according to the embodiment.

FIG. 3 is a drawing schematically illustrating a configuration of one plating module 400 in the plating apparatus 1000 according to this embodiment. FIG. 4 is a schematic cross-sectional view illustrating an enlarged region near a plating tank 10 in the plating module 400. As illustrated in FIG. 3 and FIG. 4, the plating apparatus 1000 according to this embodiment is a cup type plating apparatus. The plating module 400 in the plating apparatus 1000 according to this embodiment includes the plating tank 10, an overflow tank 20, a substrate holder 30, a rotation mechanism 40, an elevating mechanism 45, and a plating solution circulation device 50.

As illustrated in FIG. 4, the plating tank 10 according to this embodiment is configured of a container with the bottom having an opening at the upper side. Specifically, the plating tank 10 has a bottom portion 11 and an outer peripheral portion 12 (in other words, an outer peripheral side wall portion) that extends upward from the outer peripheral edge of the bottom portion 11 and is open at the upper portion. While the shape of the outer peripheral portion 12 of the plating tank 10 is not specifically limited, the outer peripheral portion 12 according to this embodiment has a cylindrical shape as one example. A plating solution Ps is stored at the inside of the plating tank 10.

As long as the plating solution Ps is a solution containing ions of a metal element constituting a plated film, the specific example is not specifically limited. In this embodiment, as an example of the plating process, a copper plating process is used, and as an example of the plating solution Ps, a copper sulfate solution is used. In this embodiment, the plating solution Ps contains a predetermined additive. However, the configuration is not limited to this, and it is possible that the plating solution Ps does not contain the additive.

An anode 60 is disposed at the inside of the plating tank 10. Specifically, the anode 60 according to this embodiment is disposed on the bottom portion 11 of the plating tank 10. The anode 60 according to this embodiment is disposed to extend in the horizontal direction.

The specific type of the anode 60 is not especially limited, and may be an insoluble anode or may be a soluble anode. In this embodiment, the insoluble anode is used as one example of the anode 60. The specific type of the insoluble anode is not especially limited, and platinum, iridium oxide, or the like can be used.

A membrane 61 is disposed above the anode 60 inside the plating tank 10. Specifically, the membrane 61 is disposed at a position between the anode 60 and a substrate Wf (a cathode). The outer peripheral portion of the membrane 61 is connected to the outer peripheral portion 12 of the plating tank 10 via a holding member 62 (see the enlarged views of the part A1 and the part A2 in FIG. 4). The membrane 61 according to this embodiment is disposed such that the surface direction of the membrane 61 is the horizontal direction.

The inside of the plating tank 10 is divided into two in the vertical direction by the membrane 61. A region comparted in the lower side of the membrane 61 where the anode 60 is disposed will be referred to as an anode chamber 13. A region on the upper side of the membrane 61 will be referred to as a cathode chamber 14.

The membrane 61 is made of a film that suppresses passing of an additive contained in the plating solution Ps while permitting metal ions to pass through. That is, in this embodiment, while the plating solution in the cathode chamber 14 contains the additive, the plating solution Ps in the anode chamber 13 does not contain the additive. However, the configuration is not limited to this, and, for example, the plating solution Ps in the anode chamber 13 may contain the additive. However, in this case as well, a concentration of the additive in the anode chamber 13 is lower than a concentration of the additive in the cathode chamber 14. The specific type of the membrane 61 is not especially limited and the known membrane can be used. As the specific example of this membrane 61, for example, an electrolytic membrane can be used, and as the specific example of the electrolytic membrane, for example, the electrolytic membrane for plating manufactured by Yuasa Membrane Systems Co., Ltd. or an ion exchange membrane can be used.

As in this embodiment, by including the membrane 61 in the plating apparatus 1000, it can be suppressed that the component in the additive contained in the plating solution Ps is decomposed or reacts by reaction at the anode side and causes a phenomenon in which a component adversely affecting the plating (that is, "the negative effect caused by the additive component") is generated.

In this embodiment, an ionically resistive element 63 is disposed inside the plating tank 10. The ionically resistive element 63 is disposed at a position between the membrane 61 in the cathode chamber 14 and the substrate Wf. The ionically resistive element 63 is made of a porous plate member having a plurality of holes (pores). The ionically resistive element 63 is a member disposed to achieve uniformization of an electric field formed between the anode 60 and the substrate Wf. Thus, by including the ionically resistive element 63 in the plating apparatus 1000, a film thickness of the plated film (a plated layer) formed on the substrate Wf can be easily uniformized. Note that this ionically resistive element 63 is not an essential member in this embodiment, and the plating apparatus 1000 can have a configuration not including the ionically resistive element 63.

The overflow tank 20 is configured of a container with the bottom disposed outside the plating tank 10. The overflow tank 20 is a tank disposed to temporarily store the plating solution Ps exceeding the upper end of the outer peripheral portion 12 of the plating tank 10 (that is, the plating solution Ps overflew from the plating tank 10). The plating solution Ps temporarily stored in the overflow tank 20 is discharged from a discharge port 72 for the overflow tank 20, and after that is temporarily stored in a reservoir tank (not illustrated) for the overflow tank 20. The plating solution Ps stored in this reservoir tank is after that circulated to the cathode chamber 14 again by a pump for overflow (not illustrated).

The substrate holder 30 holds the substrate Wf as the cathode with a surface to be plated Wfa of the substrate Wf facing the anode 60. In other words, the substrate holder 30 holds the substrate Wf with the surface to be plated Wfa of the substrate Wf facing downward. As illustrated in FIG. 3, the substrate holder 30 is connected to a rotation mechanism 40. The rotation mechanism 40 is a mechanism to rotate the substrate holder 30. The rotation mechanism 40 is connected to the elevating mechanism 45. The elevating mechanism 45 is supported by a support pillar 46 extending in the vertical direction. The elevating mechanism 45 is a mechanism to move up and down the substrate holder 30 and the rotation mechanism 40. Note that the substrate Wf and the anode 60 are electrically connected to an energization device (not illustrated). The energization device is a device to flow a current between the substrate Wf and the anode 60 while the plating process is performed.

As illustrated in FIG. 3, the plating solution circulation device 50 is a device to return the plating solution Ps discharged from the plating tank 10 to the plating tank 10. The plating solution circulation device 50 according to this embodiment includes a reservoir tank 51, a pump 52, a filter 53, and a plurality of pipes (a pipe 54*a* and a pipe 54*b*).

The pipe 54*a* is a pipe configured to supply the plating solution Ps in the anode chamber 13 to the reservoir tank 51. The pipe 54*b* is a pipe configured to supply the plating solution Ps in the reservoir tank 51 to the anode chamber 13.

The pump 52 and the filter 53 are disposed in the pipe 54*b*. The pump 52 is a fluid pressure feeding device that pressure-feeds the plating solution Ps in the reservoir tank 51 to the plating tank 10. The filter 53 is a device to remove a foreign matter contained in the plating solution Ps. Details of the reservoir tank 51 will be described later.

To perform the plating process, first, the plating solution circulation device 50 circulates the plating solution Ps. Next, the rotation mechanism 40 rotates the substrate holder 30 and the elevating mechanism 45 moves the substrate holder 30 downward to immerse the substrate Wf in the plating solution Ps in the plating tank 10. Next, the energization device flows a current between the anode 60 and the substrate Wf. This forms the plated film on the surface to be plated Wfa of the substrate Wf.

Now, with reference to FIG. 4, there may be a case where air bubbles Bu are generated in the anode chamber 13 in the cup type plating apparatus 1000 as in this embodiment for some reason. Specifically, as in this embodiment, with the use of the insoluble anode as the anode 60, when the plating process is performed (when a current is flowed), oxygen ($O_2$) is generated in the anode chamber 13 based on the following reaction equation. In this case, the generated oxygen becomes the air bubble Bu.

$$2H_2O \rightarrow O_2 + 4H^+ + 4e^-$$

Assuming that a soluble anode is used as the anode 60, the reaction equation as described above is not generated. However, for example, when the plating solution Ps is introduced first in the plating tank 10, air present inside the pipe 54*b* possibly flows in the anode chamber 13 together with the plating solution Ps. Accordingly, in the case of using the soluble anode as the anode 60 as well, the air bubbles Bu are possibly generated in the anode chamber 13.

As described above, in the case where the air bubbles Bu are generated in the anode chamber 13, assume that the air bubbles Bu are accumulated on a lower surface 61*a* of the membrane 61, the air bubbles Bu possibly blocks the electric field. In this case, the plating quality of the substrate Wf is possibly deteriorated. Therefore, in this embodiment, to suppress the accumulation of the air bubbles Bu accumulated on the lower surface of the membrane 61 and to suppress the deterioration of the plating quality of the substrate Wf caused by the air bubbles Bu, the technique that will be described below is used.

Figure 5:
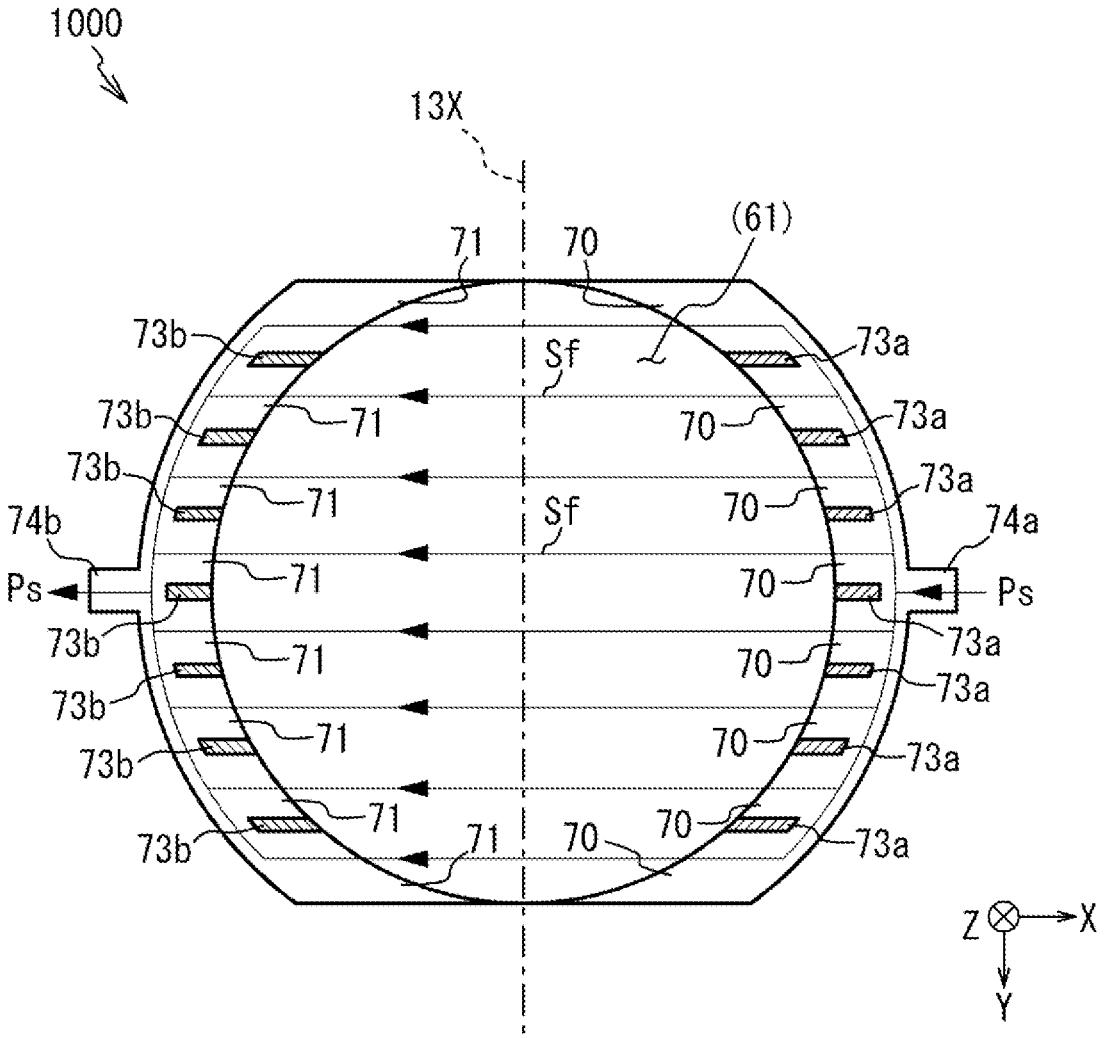
FIG. 5 is a bottom view schematically illustrating a state in which an inside of an anode chamber according to the embodiment is viewed from a lower side.

FIG. 5 is a bottom view schematically illustrating a state in which the inside of the anode chamber 13 is viewed from the lower side. In FIG. 5, cross-sectional surfaces of supply ports 70 and discharge ports 71, which will be described below, taken along the line B1-B1 in FIG. 4 are schematically illustrated. A center line 13X illustrated in FIG. 5 is a line indicative of the center of the anode chamber 13 in bottom view and also a line indicative of the center of the membrane 61 in this embodiment.

With reference to FIG. 4 and FIG. 5, the plating apparatus 1000 includes at least one supply port 70 that supplies the plating solution Ps to the anode chamber 13 in the outer peripheral portion 12 of the anode chamber 13. Specifically, the plating apparatus 1000 according to this embodiment includes a plurality of the supply ports 70. The plating apparatus 1000 includes at least one discharge port 71 that suctions the plating solution Ps in the anode chamber 13 and discharges the plating solution Ps from the anode chamber 13 in the outer peripheral portion 12 of the anode chamber 13 so as to face the supply port 70. Specifically, the plating apparatus 1000 according to this embodiment includes a plurality of the discharge ports 71, and the plurality of discharge ports 71 are disposed such that each discharge port 71 faces each supply port 70.

The supply port 70 and the discharge port 71 are configured such that the discharge port 71 suctions the plating solution Ps supplied from the supply port 70 to form a shear flow Sf of the plating solution Ps along the lower surface 61*a* on the lower surface 61*a* of the membrane 61 in the anode chamber 13. That is, the shear flow Sf according to this embodiment is a flow in the direction parallel to the lower surface 61*a* of the membrane 61, which is also a flow in the horizontal direction.

This configuration causes the air bubbles Bu in the anode chamber 13 to ride the shear flow Sf to ensure effectively discharging the air bubbles Bu from the discharge ports 71. Since this allows suppressing the accumulation of the air bubbles Bu on the lower surface 61*a* of the membrane 61, the deterioration of the plating quality of the substrate Wf caused by the air bubbles Bu can be suppressed.

Specifically, as illustrated in FIG. 5, the supply ports 70 according to this embodiment are disposed at one side (the X-direction side) with respect to the center line 13X in the outer peripheral portion 12 of the anode chamber 13 in bottom view viewing the anode chamber 13 from the lower side. The discharge ports 71 are disposed at the other side (the −X-direction side) with respect to the center line 13X in the outer peripheral portion 12 of the anode chamber 13 in bottom view. As illustrated in FIG. 4, a distance from the lower surface 61*a* of the membrane 61 to the discharge port 71 is set so as to be equal to a distance from the lower surface 61*a* of the membrane 61 to the supply port 70.

This configuration allows easily forming the shear flow Sf along the lower surface 61*a* of the membrane 61 that heads from one side to the other side across the center line 13X.

More specifically, as illustrated in FIG. 5, the supply ports 70 according to this embodiment are disposed over the whole circumference at one side with respect to the center line 13X in the outer peripheral portion 12 of the anode chamber 13. The discharge ports 71 are disposed over the whole circumference at the other side with respect to the center line 13X in the outer peripheral portion 12 of the anode chamber 13. In other words, the supply ports 70 are disposed over the semicircular part in the outer peripheral portion 12 of the anode chamber 13, and the discharge ports 71 are disposed over the semicircular part in the outer peripheral portion 12 of the anode chamber 13.

This configuration allows easily forming the shear flow Sf entirely running along the lower surface 61*a* of the membrane 61 and heading from one side to the other side across the center line 13X on the lower surface 61*a* of the membrane 61. This allows effectively discharging the air bubbles Bu in the anode chamber 13 from the discharge ports 71.

Since this configuration allows easily flowing the shear flow Sf uniformly heading from one side toward the other side across the center line 13X, a whirl can be suppressed. This also allows effectively discharging the air bubbles Bu in the anode chamber 13 from the discharge ports 71.

Note that the supply port 70 according to this embodiment discharges the plating solution Ps in the direction parallel to the lower surface 61*a* of the membrane 61 (namely, the horizontal direction). In other words, axis lines of the plurality of supply ports 70 according to this embodiment are parallel to the lower surface 61*a* of the membrane 61. Similarly, axis lines of the discharge ports 71 according to this embodiment are parallel to the lower surface 61*a* of the membrane 61. However, the axis lines of the supply ports 70 are not limited to be parallel to the lower surface 61*a* of the membrane 61. Note that another example of the supply port 70 will be described in Modification 1 (FIG. 7) described later. The axis lines of the discharge ports 71 are not limited to be parallel to the lower surface 61*a* of the membrane 61.

In this embodiment, a partition wall 73*a* is disposed between the adjacent supply ports 70, and a partition wall 73*b* is disposed between the adjacent discharge ports 71. Additionally, parts on the upstream of the plurality of supply ports 70 are joined, and an upstream-side end of the joined part will be referred to as a joining port 74*a*. The downstream-side end of the above-described pipe 54*b* is connected to the joining port 74*a*. Additionally, parts on the downstream of the plurality of discharge ports 71 are joined, and a downstream-side end of the joined part will be referred to as a joining port 74*b*. The upstream-side end of the above-described pipe 54*a* is connected to the joining port 74*b*.

However, the configurations of the supply ports 70 and the discharge ports 71 are not limited to this. For example, a configuration in which the upstream sides of the plurality of supply ports 70 are not joined, that is, a configuration in which the upstream sides of the respective supply ports 70 are connected to the reservoir tank 51 via the pipe 54*b* can be employed. Similarly, a configuration in which the downstream sides of the plurality of discharge ports 71 are not joined, that is, a configuration in which the downstream sides of the respective discharge ports 71 are connected to the reservoir tank 51 via the pipe 54*a* can be employed.

As long as the shear flow Sf can be formed, the numbers of the supply ports 70 and the discharge ports 71 are not limited to plural. For example, the plating apparatus 1000 can include only each one of the supply port 70 and the discharge port 71.

In the case where the plating apparatus 1000 includes each one of the supply port 70 and the discharge port 71, when the supply port 70 is disposed over the whole circumference at one side with respect to the center line 13X and the discharge port 71 is disposed over the whole circumference at the other side with respect to the center line 13X in the outer peripheral portion 12 of the anode chamber 13, for example, it is only necessary not to include the partition walls 73*a* or the partition walls 73*b* illustrated in FIG. 5. That is, in this case, in FIG. 5, omitting the partition walls 73*a* connects the adjacent supply ports 70 to form one large supply port. Similarly, omitting the partition walls 73*b* connects the adjacent discharge ports 71 to form one large discharge port. This allows obtaining the configuration in which one supply port 70 is disposed over the whole circumference at one side with respect to the center line 13X and one discharge port 71 is disposed over the whole circumference at the other side with respect to the center line 13X.

Although a specific value of a distance from the lower surface 61*a* of the membrane 61 to the supply port 70 or the discharge port 71 is not specifically limited, the shear flow Sf can be effectively formed on the lower surface 61*a* of the membrane 61 with the small value as much as possible, which is preferred. The preferred example is that the distance from the lower surface 61*a* of the membrane 61 to the supply port 70 or the discharge port 71 is preferably ½ or less of a distance from the lower surface 61*a* of the membrane 61 to a top surface 60*a* of the anode 60 (this will be referred to as a "distance between membrane-anode"), more preferably ¼ or less of the distance between membrane-anode, and further preferably ⅛ or less of the distance between membrane-anode.

The "distance to the supply port 70" specifically only needs to be "a distance to any location in the downstream side end surface of the supply port 70," and, for example, may be a distance to the upper end of the downstream side end surface of the supply port 70, may be a distance to the center of the downstream side end surface of the supply port 70, and may be a distance to the lower end of the downstream side end surface of the supply port 70. Similarly, the "distance to the discharge port 71" specifically only needs to be "a distance to any location in the upstream side end surface of the discharge port 71," and, for example, may be a distance to the upper end of the upstream side end surface of the discharge port 71, may be a distance to the center of the upstream side end surface of the discharge port 71, and may be a distance to the lower end of the upstream side end surface of the discharge port 71.

Figure 6:
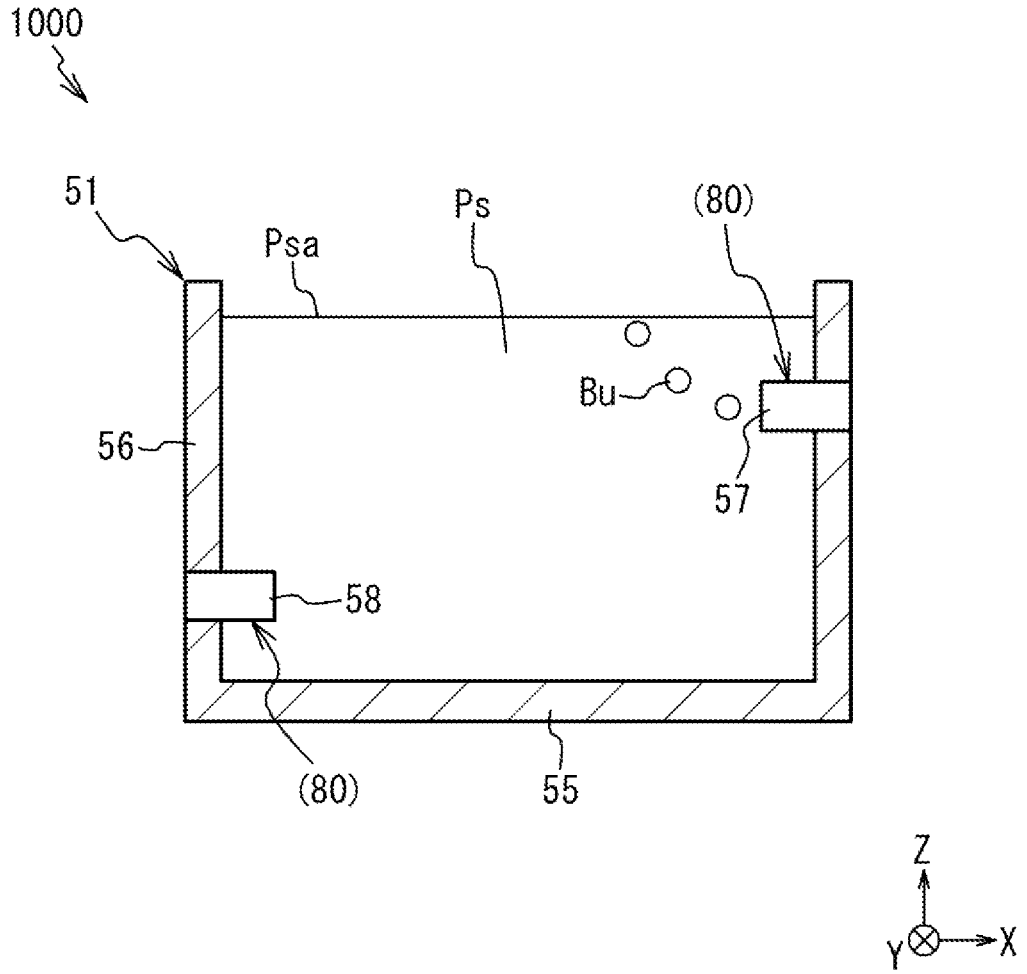
FIG. 6 is a schematic cross-sectional view of a reservoir tank according to the embodiment.

Subsequently, details of the reservoir tank 51 will be described. FIG. 6 is a schematic cross-sectional view of the reservoir tank 51 according to this embodiment. With reference to FIG. 3 and FIG. 6, the reservoir tank 51 is a tank for temporarily storing the plating solution discharged from the discharge port 71 in the anode chamber 13. The reservoir tank 51 according to this embodiment is configured of a container with the bottom having an opening at the upper side. That is, the reservoir tank 51 according to this embodiment has a bottom portion 55 and an outer peripheral portion 56 that extends upward from the outer peripheral edge of the bottom portion 55 and is open at the upper portion. Note that the upper portion of the reservoir tank 51 is not limited to the open configuration as in this embodiment, and may be, for example, closed. While the specific shape of the outer peripheral portion 56 of the reservoir tank 51 is not specifically limited, the outer peripheral portion 56 according to this embodiment has a cylindrical shape as one example.

The reservoir tank 51 has a supply port 57 (namely, a "second supply port") and a discharge port 58 (namely, a "second discharge port"). The supply port 57 is a supply port configured to communicate with the discharge port 71 in the anode chamber 13 via the pipe 54*a* and supply the plating solution Ps discharged from this discharge port 71 to the reservoir tank 51. That is, the plating solution Ps discharged from the discharge port 71 in the anode chamber 13 flows in this supply port 57 via the pipe 54*a* and is supplied to the reservoir tank 51 from this supply port 57.

The discharge port 58 is a discharge port configured to communicate with the supply port 70 in the anode chamber 13 via the pipe 54*b* and discharge the plating solution Ps in the reservoir tank 51 from the reservoir tank 51. That is, the plating solution Ps in the reservoir tank 51 is discharged from this discharge port 58, and then flows in the supply port 70 in the anode chamber 13 via the pipe 54*b*.

In this embodiment, the supply port 57 and the discharge port 58 are disposed in the outer peripheral portion 56 of the reservoir tank 51. The supply port 57 is positioned in the upper side of the discharge port 58. That is, a distance from a liquid surface Psa of the plating solution Ps in the reservoir tank 51 to the supply port 57 is smaller than a distance from this liquid surface Psa to the discharge port 58.

According to this embodiment, while flowing the air bubble Bu contained in the plating solution Ps supplied to the reservoir tank 51 from the supply port 57 in the discharge port 58 is suppressed, this air bubble Bu can float to the liquid surface Psa using buoyancy. Accordingly, the plating solution Ps not containing the air bubble Bu can be flowed in the discharge port 58, and therefore the plating solution Ps not containing the air bubble Bu can be discharged from the discharge port 58 and returned to the supply port 70 in the anode chamber 13.

That is, the supply port 57 and the discharge port 58 according to this embodiment have a function as "air bubble removing mechanisms 80" that remove the air bubbles Bu contained in the plating solution Ps supplied to the reservoir tank 51.

According to this embodiment, since the above-described air bubble removing mechanisms 80 are provided, after the air bubble Bu contained in the plating solution Ps discharged from the discharge port 71 in the anode chamber 13 is removed by the air bubble removing mechanism 80, the plating solution Ps can be returned to the supply port 70 in the anode chamber 13. This allows effectively suppressing the accumulation of the air bubbles Bu on the lower surface 61*a* of the membrane 61, and therefore the deterioration of the plating quality of the substrate Wf caused by the air bubbles Bu can be effectively suppressed.

The air bubble removing method of the plating apparatus 1000 according to this embodiment is achieved by the above-described plating apparatus 1000. That is, the air bubble removing method of the plating apparatus 1000 according to this embodiment includes supplying the plating solution Ps from the supply port 70 to the anode chamber 13 and causing the discharge port 71 to suction the supplied plating solution Ps to form the shear flow Sf of the plating solution Ps along the lower surface 61*a* on the lower surface 61*a* of the membrane 61 in the anode chamber 13. Furthermore, the air bubble removing method of the plating apparatus 1000 according to this embodiment includes after removing the air bubbles Bu contained in the plating solution Ps discharged from the anode chamber 13, returning this plating solution Ps to the anode chamber 13. The specific content of this air bubble removing method has been substantially described in the description of the plating apparatus 1000 described above, and therefore further detailed description of the air bubble removing method will be omitted.

(Modification 1)

Figure 7:
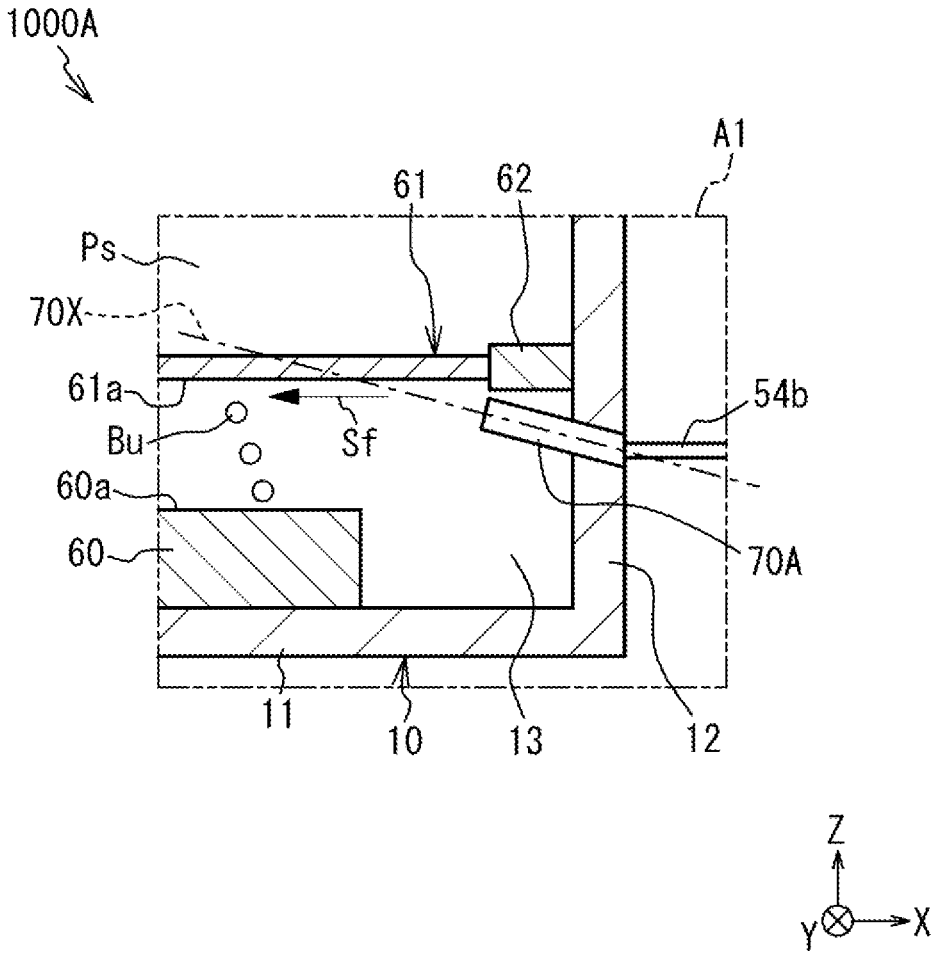
FIG. 7 is a schematic cross-sectional view illustrating an enlarged portion near a supply port in a plating apparatus according to Modification 1 of the embodiment.

Subsequently, Modification 1 of this embodiment will be described. FIG. 7 is a schematic cross-sectional view illustrating an enlarged portion (a part A1) near a supply port 70A described later of a plating apparatus 1000A according to this modification. The plating apparatus 1000A according to this modification differs from the above-described plating apparatus 1000 in that the supply port 70A is provided instead of the supply port 70. The supply port 70A differs from the supply port 70 illustrated in FIG. 4 in that the supply port 70A discharges the plating solution Ps obliquely upward. Specifically, the supply port 70A according to this modification is disposed such that an axis line 70X of the supply port 70A intersects with the lower surface 61*a* of the membrane 61 while the supply port 70A faces the discharge port 71.

In this modification as well, the discharge port 71 suctions the plating solution Ps supplied from the supply port 70A to ensure forming the shear flow Sf of the plating solution Ps along the lower surface 61*a* on the lower surface 61*a* of the membrane 61 in the anode chamber 13. Since this allows suppressing the accumulation of the air bubbles Bu on the lower surface 61*a* of the membrane 61, the deterioration of the plating quality of the substrate Wf caused by the air bubbles Bu can be suppressed.

(Modification 2)

Figure 8:
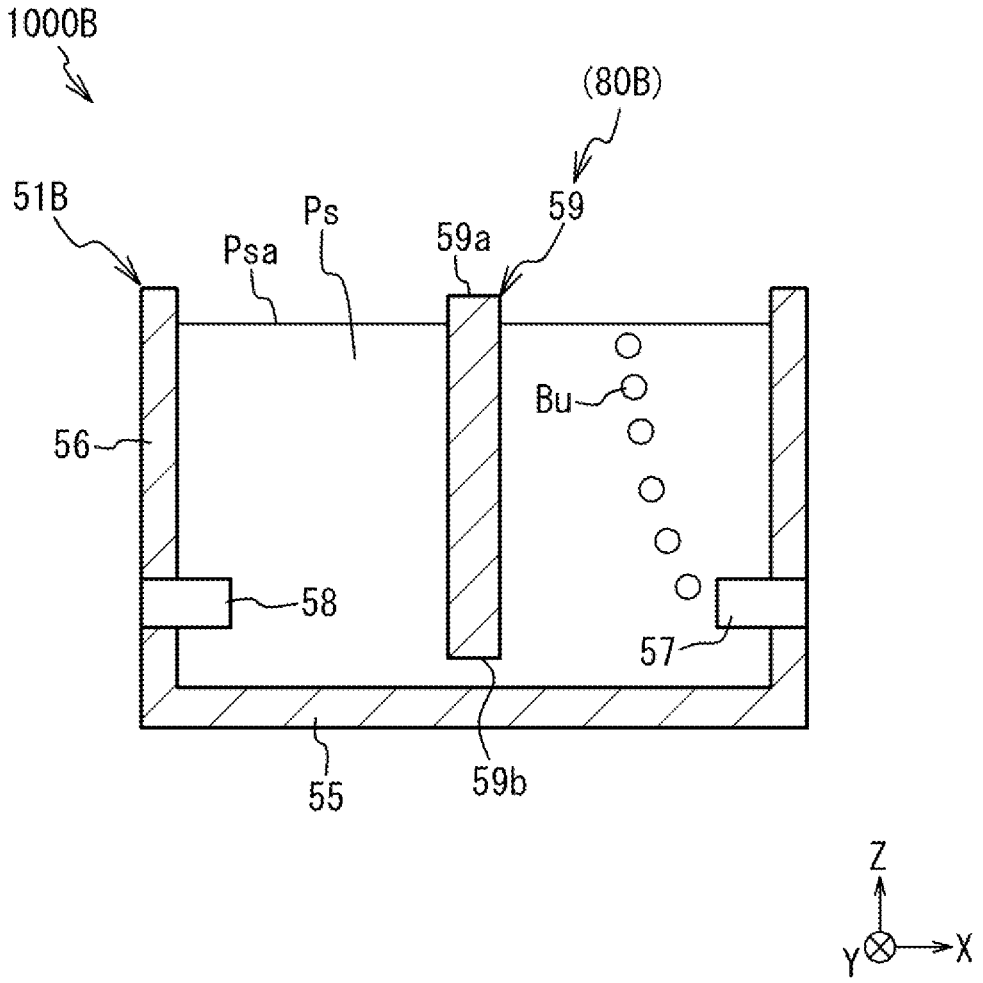
FIG. 8 is a schematic cross-sectional view of a reservoir tank in a plating apparatus according to Modification 2 of the embodiment.

Subsequently, Modification 2 of this embodiment will be described. FIG. 8 is a schematic cross-sectional view of a reservoir tank 51B of a plating apparatus 1000B according to this modification. The reservoir tank 51B according to this modification differs from the reservoir tank 51 illustrated in FIG. 6 in that the supply port 57 is disposed at the height same as that of the discharge port 58 and an air bubble removing mechanism 80B is provided instead of the air bubble removing mechanism 80. The air bubble removing mechanism 80B according to this modification differs from the air bubble removing mechanism 80 illustrated in FIG. 6 in that the supply port 57 or the discharge port 58 is not provided but a partition member 59 described later is provided.

The partition member 59 projects upward with respect to the liquid surface Psa of the plating solution Ps in the reservoir tank 51B and extends downward with respect to the liquid surface Psa in the reservoir tank 51B within the range not in contact with the bottom portion 55 of the reservoir tank 51B. That is, an upper end 59*a* of the partition member 59 projects upward with respect to the liquid surface Psa, and a lower end 59*b* of the partition member 59 is positioned downward with respect to the liquid surface Psa and has a clearance with the bottom portion 55. Note that the partition member 59 according to this modification extends in the Y-direction and the −Y-direction in FIG. 8, and the end on the Y-direction side and the end on the −Y-direction side are connected to the outer peripheral portion 56 of the reservoir tank 51B to fix its position. However, the fixing method of the partition member 59 to the reservoir tank 51B is not limited to this.

In the cross-sectional surface view of the reservoir tank 51B, the supply port 57 ("the second supply port") is disposed at one side (the X-direction side) with respect to the partition member 59. The discharge port 58 ("the second discharge port") is disposed at the other side (the −X-direction side) with respect to the partition member 59. The lower end 59*b* of the partition member 59 is positioned downward with respect to the supply port 57.

According to this modification, flowing the air bubble Bu contained in the plating solution Ps supplied from the supply port 57 to the reservoir tank 51B in the other side (the discharge port 58 side) with respect to the partition member 59 can be suppressed. Specifically, the air bubble Bu contained in the plating solution Ps supplied from the supply port 57 floats to the liquid surface Psa using buoyancy. Flowing the air bubbles Bu in the middle of floating to this liquid surface Psa and the air bubbles Bu that have floated to the liquid surface Psa in the discharge port 58 side with respect to the partition member 59 can be suppressed. Note that since the lower end 59*b* of the partition member 59 does not contact the bottom portion 55 of the reservoir tank 51B, the plating solution Ps stored at the supply port 57 side with respect to the partition member 59 of the reservoir tank 51B can pass through the clearance between this lower end 59*b* and the bottom portion 55 to flow in the discharge port 58 side with respect to the partition member 59. Thus, flowing the plating solution Ps at the supply port 57 side with respect to the partition member 59 in the discharge port 58 side exceeding the upper end 59*a* of the partition member 59 is suppressed.

As described above, according to this modification, after the air bubble Bu contained in the plating solution Ps supplied from the supply port 57 to the reservoir tank 51B is removed, the plating solution Ps can be discharged from the discharge port 58 and returned to the supply port 70 in the anode chamber 13. This allows effectively suppressing the accumulation of the air bubbles Bu on the lower surface 61*a* of the membrane 61, and therefore the deterioration of the plating quality of the substrate Wf caused by the air bubbles Bu can be effectively suppressed.

In FIG. 8, the supply port 57 is disposed at the height same as that of the discharge port 58, but the configuration is not limited to this. The supply port 57 may be disposed at a height different from the discharge port 58.

In this modification, the lower end 59*b* of the partition member 59 is positioned downward with respect to the supply port 57, but the configuration is not limited to this. The lower end 59*b* of the partition member 59 may be positioned upward with respect to the supply port 57. However, compared with the case where this lower end 59*b* is positioned upward with respect to the supply port 57, the case where the lower end 59*b* of the partition member 59 is positioned downward with respect to the supply port 57 is preferred because it can be effectively suppressed that the air bubbles Bu contained in the plating solution Ps supplied from the supply port 57 pass through the clearance between the lower end 59*b* of the partition member 59 and the bottom portion 55 of the reservoir tank 51B and flow in the discharge port 58 side with respect to the partition member 59.

The plating apparatus 100B according to this modification may further have the features of the plating apparatus 1000A according to Modification 1 described above.

(Modification 3)

Figure 9:
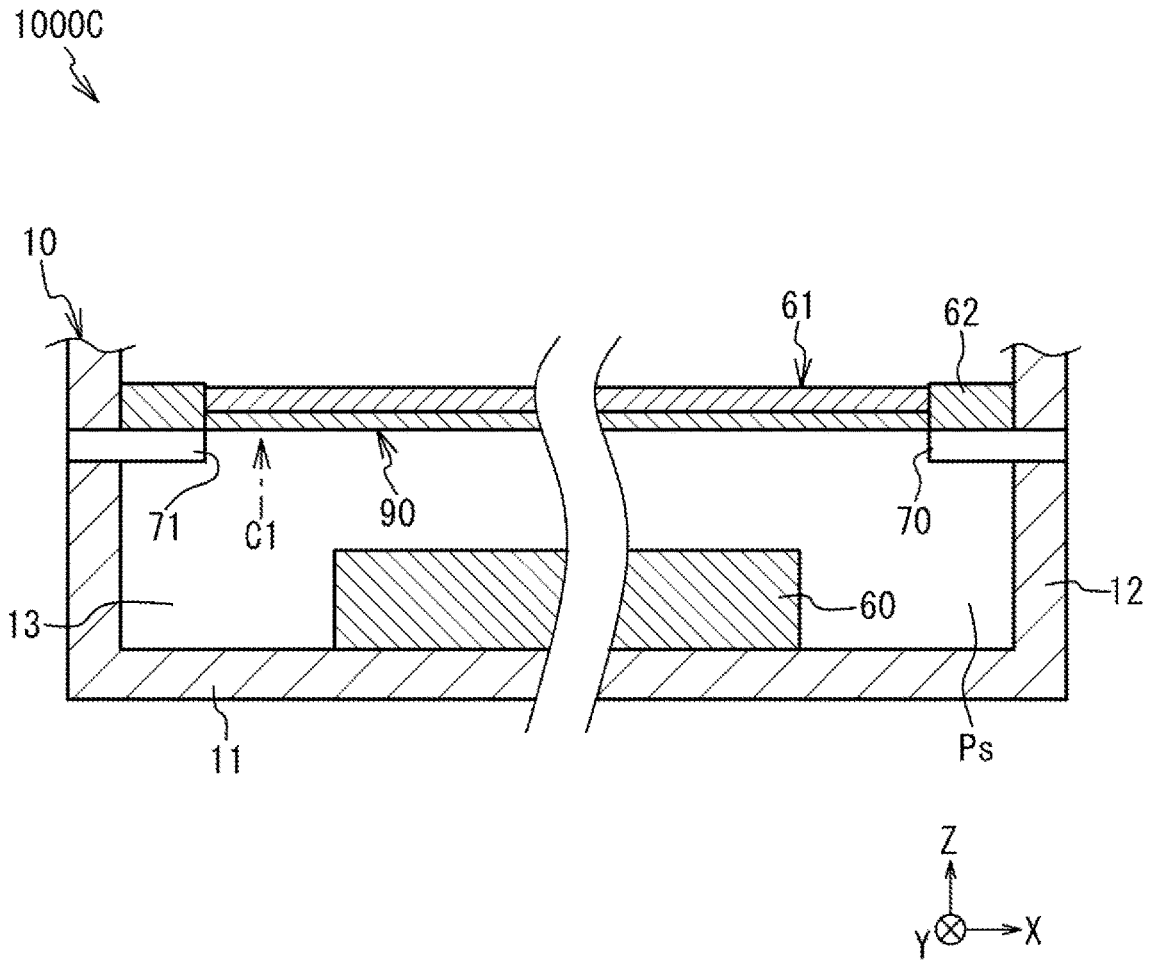
FIG. 9 is a schematic cross-sectional view illustrating an enlarged region near an anode chamber in a plating apparatus according to Modification 3 of the embodiment.
Figure 10:
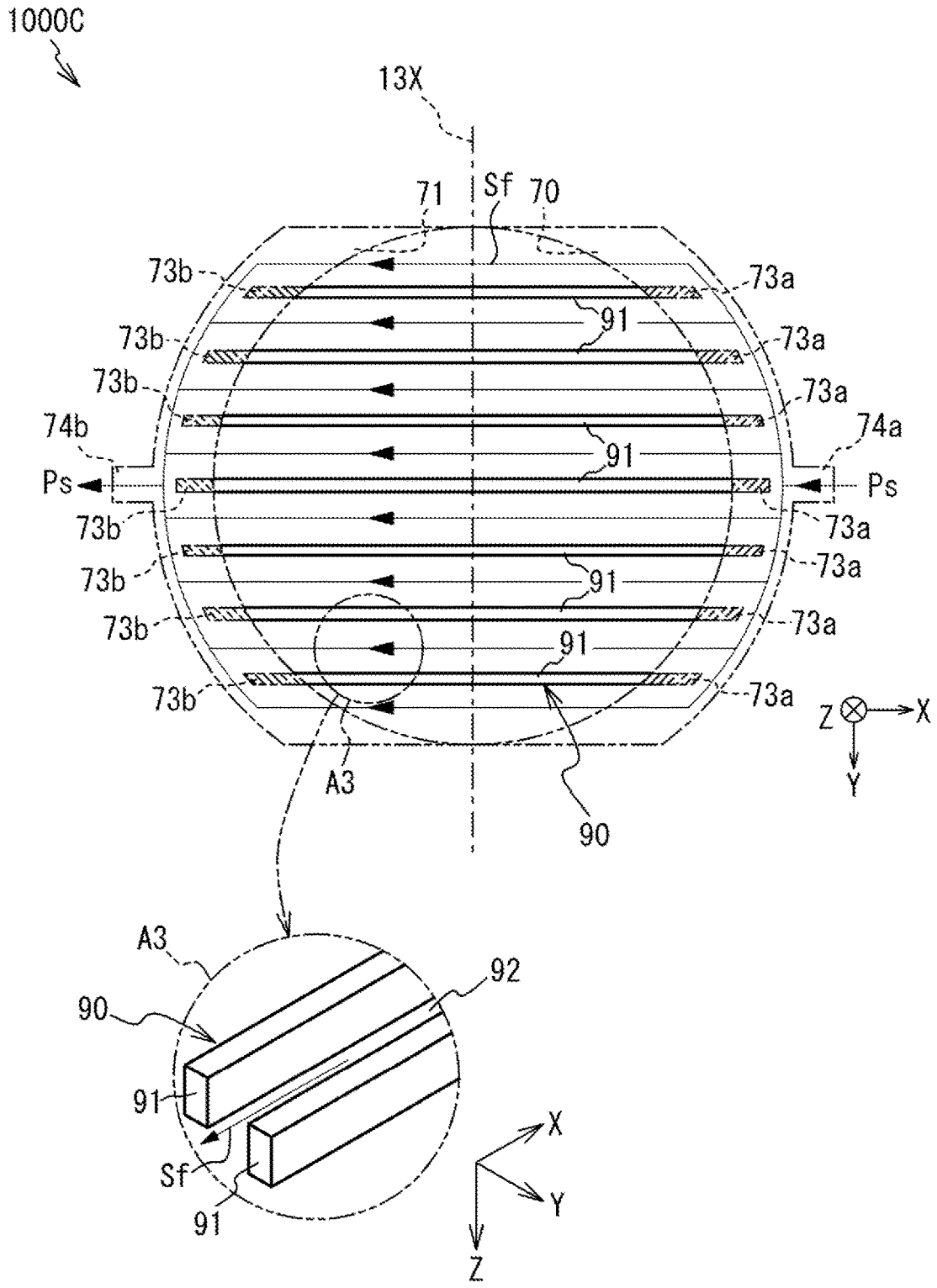
FIG. 10 is a bottom view schematically illustrating a state in which a guide member according to Modification 3 of the embodiment is viewed from a lower side.

Subsequently, Modification 3 of this embodiment will be described. FIG. 9 is a schematic cross-sectional view illustrating an enlarged region near the anode chamber 13 in a plating apparatus 1000C according to this modification. The plating apparatus 1000C according to this modification differs from the plating apparatus 1000 illustrated in FIG. 4 in that a guide member 90 is further provided. FIG. 10 is a bottom view schematically illustrating a state in which the guide member 90 is viewed from a lower side (the C1 direction in FIG. 9). For reference, FIG. 10 also illustrates the supply port 70 and the discharge port 71 by the imaginary lines (the two-dot chain lines). FIG. 10 also illustrates a schematic perspective view of a part of (a part A3) of the guide member 90.

As illustrated in FIG. 9 and FIG. 10, the guide member 90 is disposed on the lower surface 61*a* of the membrane 61. The guide member 90 is a member that guides the flow of the shear flow Sf flowing along the lower surface 61*a* of the membrane 61.

Specifically, as illustrated in FIG. 10, the guide member 90 according to this modification includes a plurality of guide plates 91. The ends at the X-direction and the −X-direction sides of the plurality of guide plates 91 are held by the above-described holding member 62. The plurality of guide plates 91 are arranged in the direction (the Y-axis direction) along the center line 13X of the anode chamber 13 so as to form a clearance with the guide plate 91 adjacent to one another.

Among the plurality of guide plates 91, a clearance provided between the guide plate 91 disposed at the end in the direction along the center line 13X and the outer peripheral portion 12 of the anode chamber 13, and a clearance provided between the guide plates 91 facing one another function as guide flow passages 92 to guide the shear flow Sf flowing along the lower surface 61*a* of the membrane 61 in the direction heading from the supply port 70 to the discharge port 71. This guide flow passage 92 is disposed so as to communicate between the respective supply ports 70 and the respective discharge ports 71 in bottom view.

According to this modification, the shear flow Sf supplied from the supply port 70 and flowing along the lower surface 61*a* of the membrane 61 can be guided by the guide member 90 and effectively suctioned to the discharge port 71. This allows easily forming the strong shear flow Sf. Consequently, this allows effectively suppressing the accumulation of the air bubbles Bu on the lower surface 61*a* of the membrane 61, and therefore the deterioration of the plating quality of the substrate Wf caused by the air bubbles Bu can be effectively suppressed.

The plating apparatus 1000C according to this modification may further have the features of the plating apparatus 1000A according to Modification 1 and/or the features of the plating apparatus 100B according to Modification 2 described above.

(Modification 4)

Figure 11:
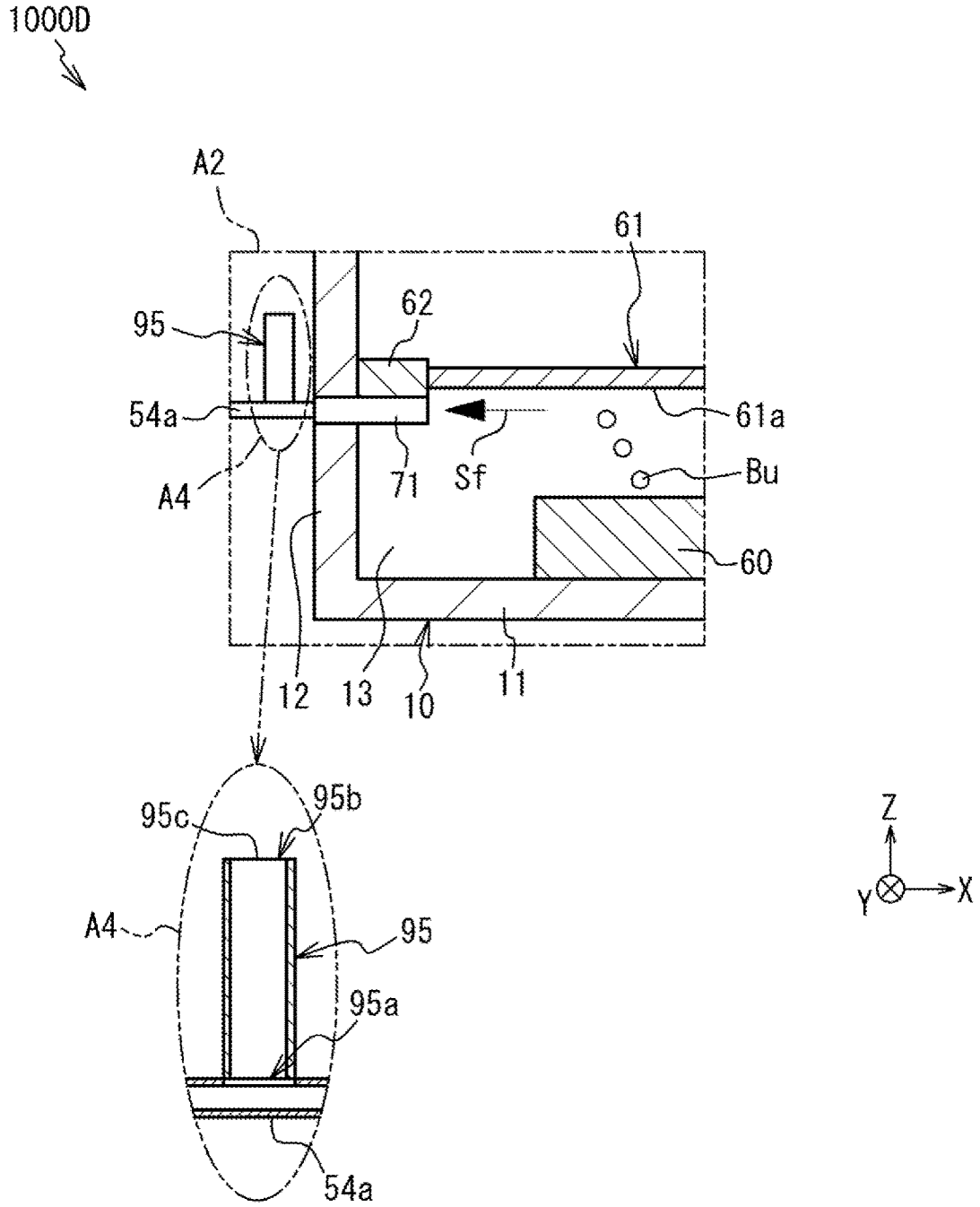
FIG. 11 is a schematic cross-sectional view illustrating an enlarged region near a discharge port in a plating apparatus according to Modification 4 of the embodiment.

Subsequently, Modification 4 of this embodiment will be described. FIG. 11 is a schematic cross-sectional view illustrating an enlarged region near the discharge port 71 in a plating apparatus 1000D according to this modification. The plating apparatus 1000D according to this modification differs from the plating apparatus 1000 illustrated in FIG. 4 in that a gas purge pipe 95 is further provided. For reference, FIG. 11 also illustrates a schematic cross-sectional view of a region (a part A4) near the gas purge pipe 95.

The gas purge pipe 95 is a pipe member that is disposed at a location from the discharge port 71 to the reservoir tank 51 in the flow direction of the plating solution Ps and for discharging a gas contained in the plating solution Ps flowing the location to the atmosphere. Specifically, the gas purge pipe 95 according to this modification is connected to a portion in the middle of the pipe 54*a* so as to communicate between the middle portion of the pipe 54*a* and the atmosphere.

More specifically, the gas purge pipe 95 according to this modification has one end 95*a* communicated with the portion in the middle of the pipe 54*a*. The gas purge pipe 95 has an atmosphere release hole 95*c* for releasing the gas that has passed through the gas purge pipe 95 to the atmosphere. The atmosphere release hole 95*c* according to this modification is provided in an other end 95*b* of the gas purge pipe 95 as one example. The other end 95*b* of the gas purge pipe 95 is positioned in the upper side of the one end 95*a*. The gas contained in the air bubble Bu in the plating solution Ps flowing through the pipe 54*a* passes through the gas purge pipe 95 and is discharged from the atmosphere release hole 95*c* to the atmosphere. Thus, the air bubbles Bu vanish.

According to this modification, as described above, since the air bubbles Bu in the plating solution Ps flowing from the anode chamber 13 toward the reservoir tank 51 can be vanished, it can be suppressed that the plating solution Ps supplied to the reservoir tank 51 contains the air bubbles Bu. Thus, it can be suppressed that the plating solution Ps returned from the reservoir tank 51 to the anode chamber 13 contains the air bubbles Bu, and therefore the accumulation of the air bubbles Bu on the lower surface 61*a* of the membrane 61 can be effectively suppressed. Consequently, the deterioration of the plating quality of the substrate Wf caused by the air bubbles Bu can be effectively suppressed.

The plating apparatus 1000D according to this modification may further have the features of the plating apparatus 1000A according to Modification 1 and/or the features of the plating apparatus 1000B according to Modification 2, and/or the features of the plating apparatus 1000C according to Modification 3 described above.

As described above, while the details of the embodiments and the modifications of the present invention have been described, the present invention is not limited to the specific embodiments or modifications, and various kinds of further modifications and changes can be made within the gist of the present invention described in the claims.

REFERENCE SIGNS LIST

10 . . . plating tank
12 . . . outer peripheral portion
13 . . . anode chamber
13X . . . center line
30 . . . substrate holder
50 . . . plating solution circulation device
51 . . . reservoir tank
55 . . . bottom portion
57 . . . supply port (second supply port)
58 . . . discharge port (second discharge port)
59 . . . partition member
60 . . . anode
61 . . . membrane
61*a* . . . lower surface
70 . . . supply port
71 . . . discharge port
80 . . . air bubble removing mechanism
90 . . . guide member
95 . . . gas purge pipe
1000 . . . plating apparatus
Wf . . . substrate
Wfa . . . surface to be plated
Ps . . . plating solution
Psa . . . liquid surface
Sf . . . shear flow
Bu . . . air bubble

What is claimed is:

1. A plating apparatus comprising:

a plating tank that includes a membrane disposed in the plating tank, an anode chamber comparted in a lower side of the membrane in the plating tank, and an anode disposed in the anode chamber;

a substrate holder disposed above the anode chamber, the substrate holder being configured to hold a substrate as a cathode with a surface to be plated of the substrate facing the anode;

at least one supply port disposed in an outer peripheral portion of the anode chamber, the at least one supply port being configured to supply a plating solution to the anode chamber;

at least one discharge port disposed in the outer peripheral portion of the anode chamber so as to face the at least one supply port, the at least one discharge port being configured to suction the plating solution in the anode chamber and discharge the plating solution from the anode chamber, a holding member provided at the outer peripheral portion of the anode chamber, and configured to hold an outer peripheral portion of the membrane; and a guide member, the guide member comprising a plurality of guide plates, disposed on the lower surface of the membrane, and being configured to guide a flow of the shear flow flowing along the lower surface of the membrane; wherein the at least one supply port and the at least one discharge port are configured such that the at least one discharge port suctions the plating solution supplied from the at least one supply port to form a shear flow of the plating solution along a lower surface on the lower surface of the membrane in the anode chamber; and the plurality of guide plates have first ends provided on one directional side in a direction of extension of the plurality of guide plates and second ends provided on the other directional side in the direction of extension of the plurality of guide plates, and the first ends and the second ends are held by the holding member.

2. The plating apparatus according to claim 1, wherein the at least one supply port is disposed at one side with respect to a center line of the anode chamber in the outer peripheral portion of the anode chamber in bottom view viewing the anode chamber from a lower side, the at least one discharge port is disposed at the other side with respect to the center line in the outer peripheral portion of the anode chamber in the bottom view, and a distance from the lower surface of the membrane to the at least one discharge port is equal to a distance from the lower surface to the at least one supply port.

3. The plating apparatus according to claim 2, wherein the at least one supply port comprises a plurality of supply ports, the at least one discharge port comprises a plurality of discharge ports, the plurality of supply ports are disposed over an entire one side of a circumference with respect to the center line in the outer peripheral portion of the anode chamber, and the plurality of discharge ports are disposed over an entire other side of the circumference with respect to the center line in the outer peripheral portion of the anode chamber.

4. The plating apparatus according to claim 1, further comprising a plating solution circulation device configured to return the plating solution discharged from the at least one discharge port to the at least one supply port, wherein the plating solution circulation device includes a reservoir tank, and the reservoir tank is configured to temporarily store the plating solution discharged from the at least one discharge port.

5. The plating apparatus according to claim 4, wherein the reservoir tank includes an air bubble removing mechanism configured to remove the air bubble contained in the plating solution supplied to the reservoir tank, the air bubble removing mechanism comprising a second supply port and a second discharge port;

wherein the second supply port communicates with the at least one discharge port and is configured to supply the plating solution discharged from the at least one discharge port to the reservoir tank, and the second discharge port communicates with the at least one supply port and is configured to discharge the plating solution in the reservoir tank from the reservoir tank, and wherein the second supply port is positioned above the second discharge port.

6. The plating apparatus according to claim 4, wherein the reservoir tank includes an air bubble removing mechanism configured to remove the air bubble contained in the plating solution supplied to the reservoir tank, the air bubble removing mechanism comprising a partition member;

the reservoir tank includes a second supply port and a second discharge port, wherein the second supply port communicates with the at least one discharge port and is configured to supply the plating solution discharged from the at least one discharge port to the reservoir tank, the second discharge port communicates with the at least one supply port and is configured to discharge the plating solution in the reservoir tank from the reservoir tank, the partition member is configured to project upward with respect to a liquid surface of the plating solution in the reservoir tank, and the partition member extends downward with respect to the liquid surface in the reservoir tank within a range not in contact with a bottom portion of the reservoir tank, and wherein in a cross-sectional surface view of the reservoir tank, the second supply port is disposed at one side with respect to the partition member, and the second discharge port is disposed at the other side with respect to the partition member.

7. The plating apparatus according to claim 4, wherein the plating solution circulation device further includes a gas purge pipe at a portion from the at least one discharge port to the reservoir tank in a flow direction of the plating solution, and the gas purge pipe is configured to discharge a gas contained in the plating solution flowing through the portion to an atmosphere.

8. The plating apparatus according to claim 1, wherein a distance from the lower surface of the membrane to the at least one supply port and the at least one discharge port is a distance ½ or less from the lower surface of the membrane to a top surface of the anode.

9. The plating apparatus according to claim 8, wherein the distance from the lower surface of the membrane to the at least one supply port and the at least one discharge port is a distance ¼ or less from the lower surface of the membrane to the top surface of the anode.

10. The plating apparatus according to claim 9, wherein the distance from the lower surface of the membrane to the at least one supply port and the at least one discharge port is a distance ⅛ or less from the lower surface of the membrane to the top surface of the anode.

11. The plating apparatus according to claim 1, wherein the membrane is disposed horizontally.

12. The plating apparatus according to claim 1, wherein the at least one supply port and the at least one discharge port are parallel to the membrane.

13. The plating apparatus according to claim 1, wherein the plating apparatus further comprising:

a first joining port; and a second joining port, wherein the at least one supply port comprises a plurality of supply ports, the at least one discharge port comprises a plurality of discharge ports;

upstream ends of the plurality of supply ports join the first joining port, and downstream ends of the plurality of discharge ports join the second joining port.

* * * * *